US012510339B2

(12) United States Patent
Burnsed, Jr. et al.

(10) Patent No.: US 12,510,339 B2
(45) Date of Patent: Dec. 30, 2025

(54) GRENADE POUCH ADAPTER

(71) Applicant: Blue Force Gear, Inc., Pooler, GA (US)

(72) Inventors: Ashley A. Burnsed, Jr., Savannah, GA (US); Stephen G. Hilliard, Cainhoy, SC (US)

(73) Assignee: Blue Force Gear, Inc., Pooler, GA (US)

( * ) Notice: Subject to any disclaimer, the term of this patent is extended or adjusted under 35 U.S.C. 154(b) by 313 days.

(21) Appl. No.: 18/467,540

(22) Filed: Sep. 14, 2023

(65) Prior Publication Data

US 2024/0085161 A1 Mar. 14, 2024

Related U.S. Application Data

(60) Provisional application No. 63/406,314, filed on Sep. 14, 2022.

(51) Int. Cl.
*F42B 39/02* (2006.01)

(52) U.S. Cl.
CPC ..... *F42B 39/02* (2013.01)

(58) Field of Classification Search
CPC ..... F42B 39/02; F42B 27/00; F42B 30/04; A45F 5/1566; A45F 5/02; A45F 5/021
USPC ..... 224/191; 102/483, 368
See application file for complete search history.

(56) References Cited

U.S. PATENT DOCUMENTS

| | | | | |
|---|---|---|---|---|
| 2,670,886 | A * | 3/1954 | Walton | F42B 27/00 224/678 |
| 2,797,034 | A * | 6/1957 | Blackman | F42B 39/02 224/247 |
| 7,669,742 | B2 * | 3/2010 | Rush | F41C 33/0236 248/316.1 |
| 8,651,347 | B1 * | 2/2014 | Molcho | A45F 5/021 224/660 |
| D876,829 | S * | 3/2020 | Benn | D3/223 |
| 2012/0111882 | A1 * | 5/2012 | Milligan | F42B 39/02 221/151 |

* cited by examiner

*Primary Examiner* — Corey N Skurdal
(74) *Attorney, Agent, or Firm* — Eversheds Sutherland (US) LLP

(57) ABSTRACT

A grenade pouch adapter for receiving a grenade is provided. The grenade pouch adapter includes a curved body having a planar surface, an inner surface, and an outer surface. The inner surface extends perpendicularly from a first edge of the planar surface and defines an inner contour of the curved body. The outer surface extends perpendicularly from a second edge of the planar surface. A spoon slot is located at a first end of the curved body. The spoon of the grenade is received into the spoon slot through a spoon aperture formed on the planar surface of the curved body. The spoon slot is configured to hold the spoon of the grenade in a single orientation such that a safety pin ring of the grenade is positioned facing towards wearer's body.

18 Claims, 9 Drawing Sheets

GRENADE POUCH ADAPTER

RELATED APPLICATION

Under provisions of 35 U.S.C. § 119(e), Applicant claims the benefit of U.S. Provisional Application No. 63/406,314, filed Sep. 14, 2022, which is incorporated herein by reference.

TECHNICAL FIELD

The present disclosure relates generally to grenade, and more particularly to a grenade pouch adapter.

BACKGROUND

Grenades are explosive devices used by various personas, for example, law enforcement, or military personnel, as a projectile to attack a target at a distance as a thrower. There are various types of grenades available, for example, fragment grenade, stun grenade, smoke grenade, incendiary grenade, etc. When used grenades create an explosion that is intended to injure, emit a blaring noise, create smoke, and the like.

Grenades are carried in grenade pouches. Grenade pouches are commonly designed to attach to tactical vests, tactical belts or anywhere else on a user's body so the grenade pouches can be worn. Grenade pouches are designed with flaps that secure the grenades within the grenade pouches while still enabling quick access to the grenades contained therein. Although grenade pouches provide obvious advantages to the wearer, conventional approaches have also suffered from significant disadvantages. For example, grenades are frequently stored on the upper back of a co-soldier, swat or team member so the person behind them could grab a grenade. When replacing a removed grenade, the person behind is typically in duress and not paying attention and typically installs and secures the new grenade backwards (i.e., the safety pin ring facing outwards prone to snagging and inadvertent release) which could be very dangerous to the user and those around.

SUMMARY OF THE INVENTION

In accordance with example embodiments of the disclosure, a grenade pouch adapter for receiving a grenade is provided. The grenade pouch adapter includes a curved body having a planar surface, an inner surface, and an outer surface. The inner surface extends perpendicularly from a first edge of the planar surface and defines an inner contour of the curved body. The outer surface extends perpendicularly from a second edge of the planar surface. A spoon slot is located at a first end of the curved body. The spoon of the grenade is received into the spoon slot through a spoon aperture formed on the planar surface of the curved body. The spoon slot is configured to hold the spoon of the grenade in a single orientation such that a safety pin ring of the grenade is positioned facing towards wearer's body.

In accordance with another example embodiments of the disclosure, a grenade pouch adapter includes a curved body for receiving a grenade. The curved body includes a planar surface, an inner surface, and an outer surface. The inner surface extends perpendicularly from a first edge of the planar surface and defines an inner contour of the curved body. The outer surface extends perpendicularly from a second edge of the planar surface. A spoon slot is located at a first end of the curved body. The spoon of the grenade is received into the spoon slot through a spoon aperture formed on the planar surface of the curved body. The spoon slot is configured to hold the spoon of the grenade in a single orientation such that the safety pin ring of the grenade is positioned facing towards wearer's body.

In accordance with example embodiments of the disclosure, an apparatus comprises a grenade pouch for receiving a grenade, the grenade having a spoon and a safety pin ring connected to a safety pin of the grenade. A spoon slot is attached to the grenade pouch. The spoon of the grenade is received into a cavity of the spoon slot. The spoon slot is configured to hold the spoon of the grenade in a single orientation such that the safety pin ring of the grenade is positioned facing towards wearer's body.

BRIEF DESCRIPTION OF THE DRAWINGS

The accompanying drawings, which are incorporated in and constitute a part of this disclosure, illustrate various embodiments of the present disclosure. In the drawings.

DETAILED DESCRIPTION

Figure 1A:
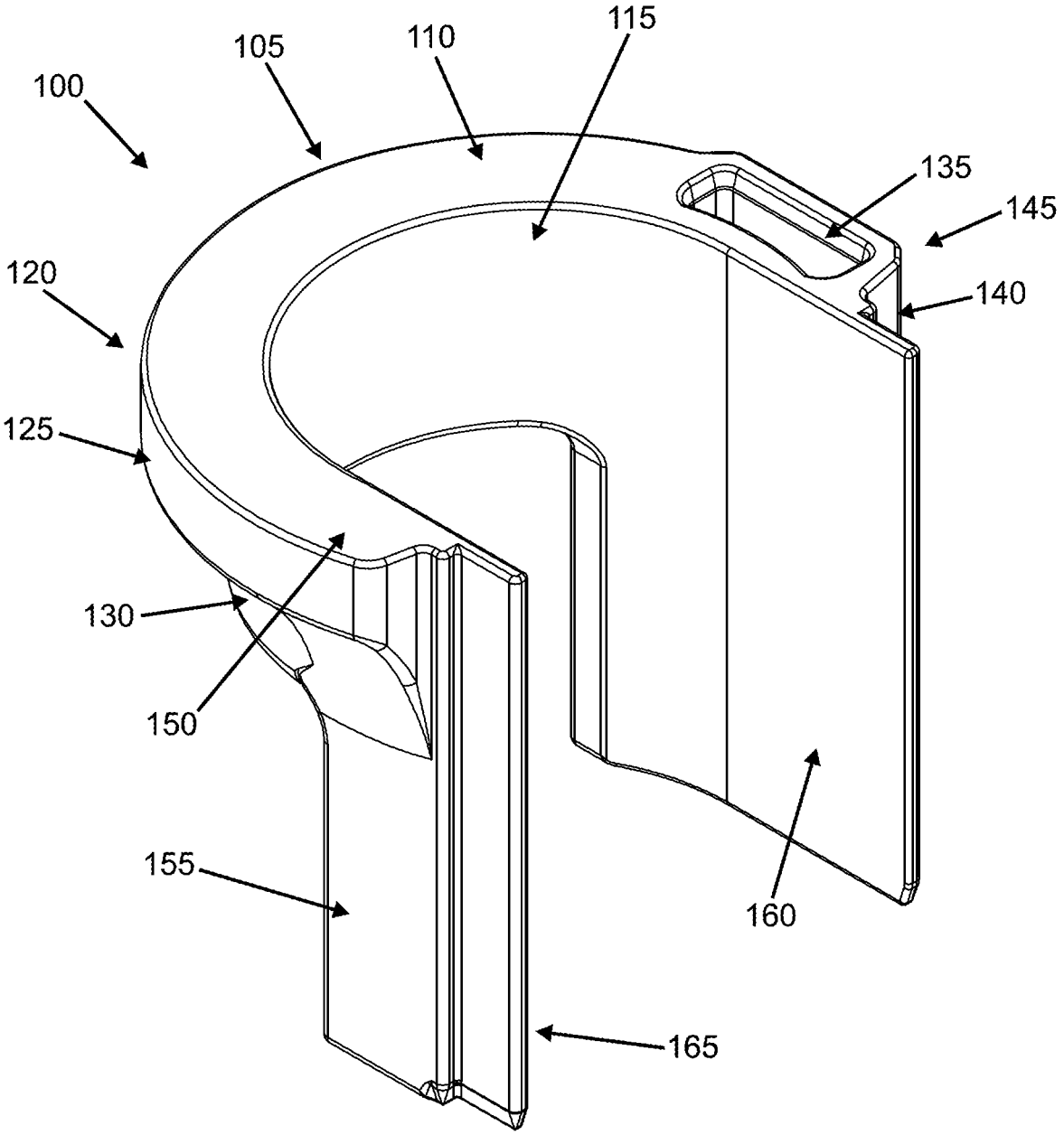
FIG. 1A, FIG. 1B, FIG. 1C, and FIG. 1D are diagrams of a grenade pouch adapter.
Figure 1B:
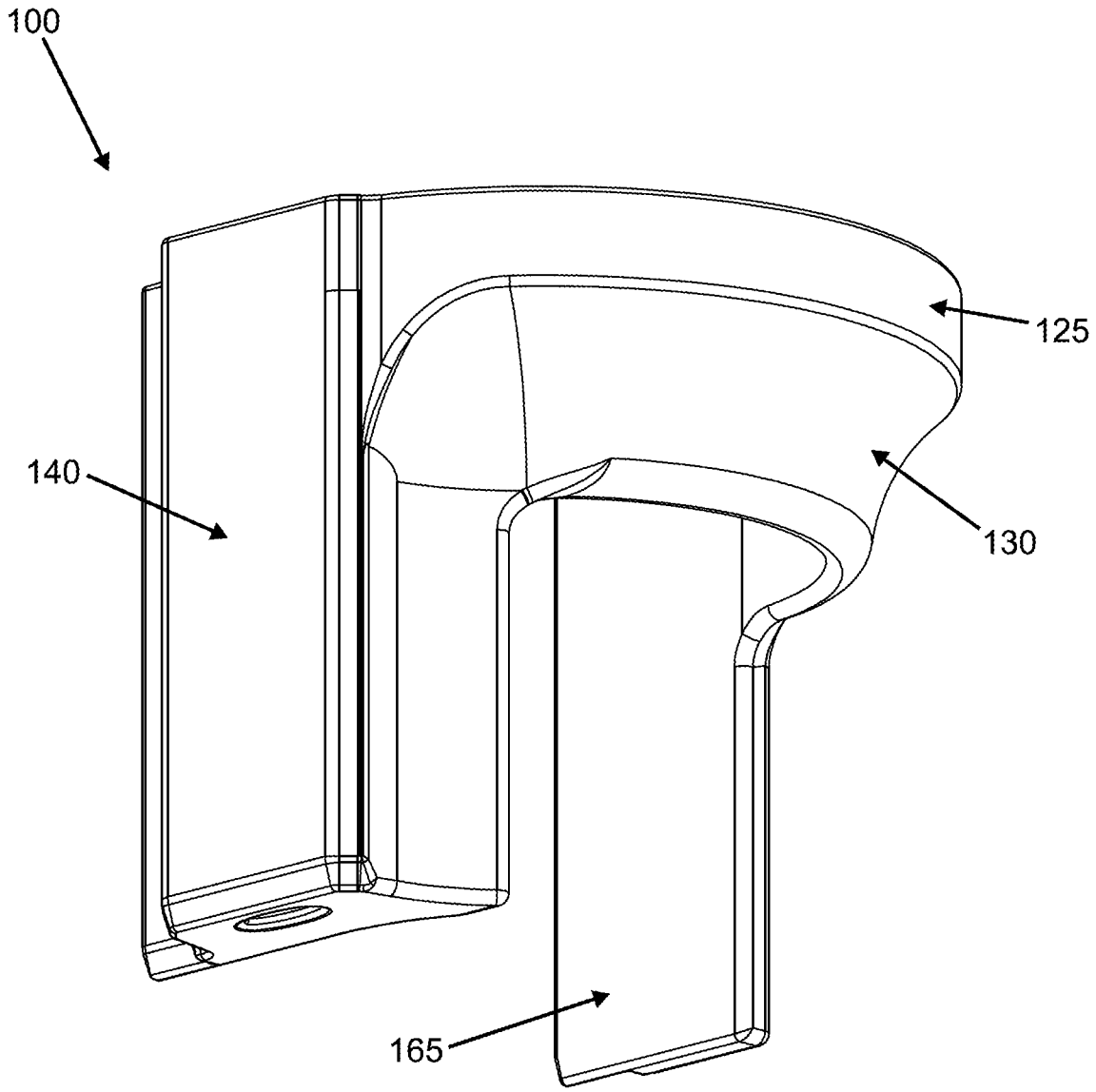
Figure 1C:
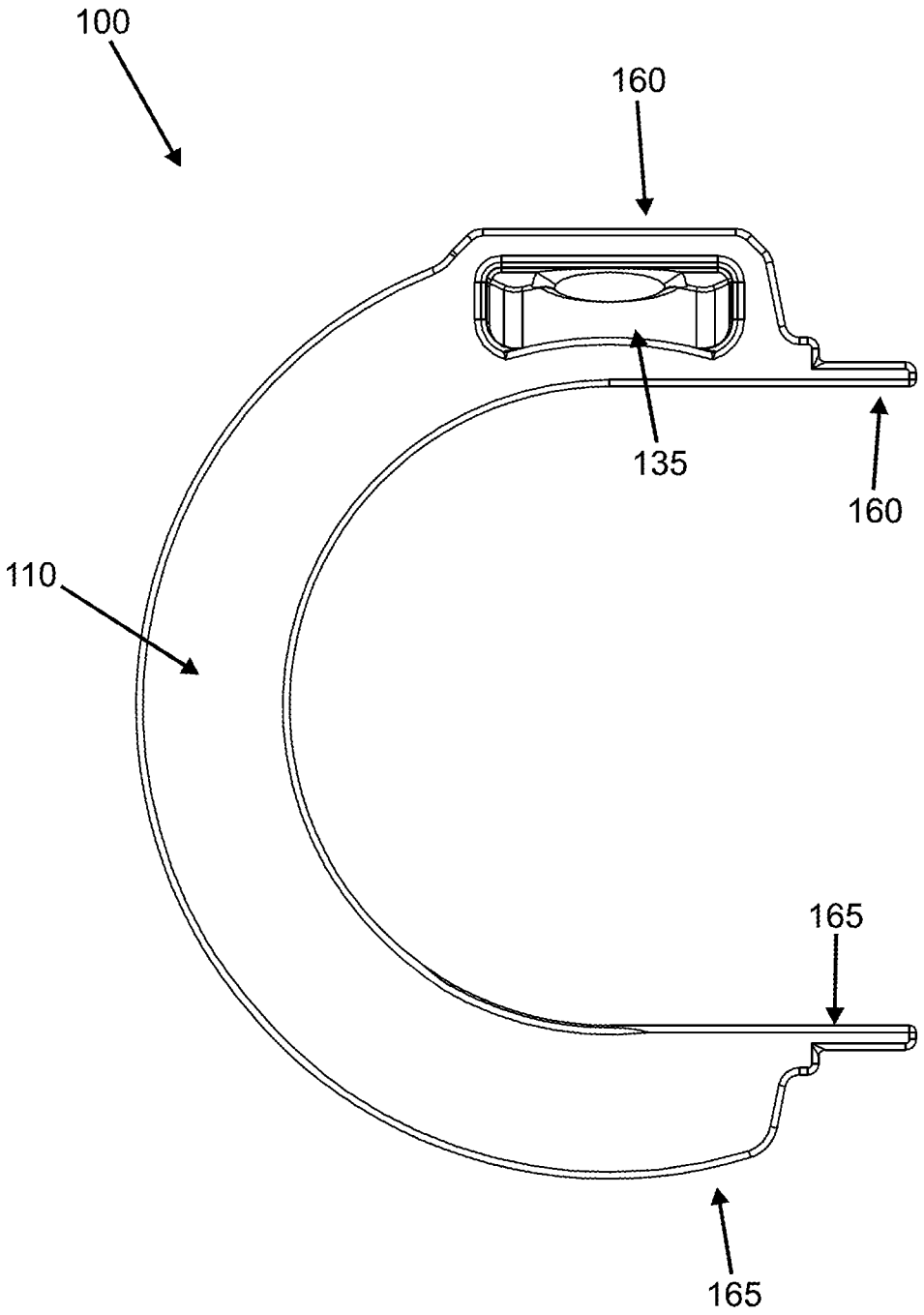
Figure 1D:
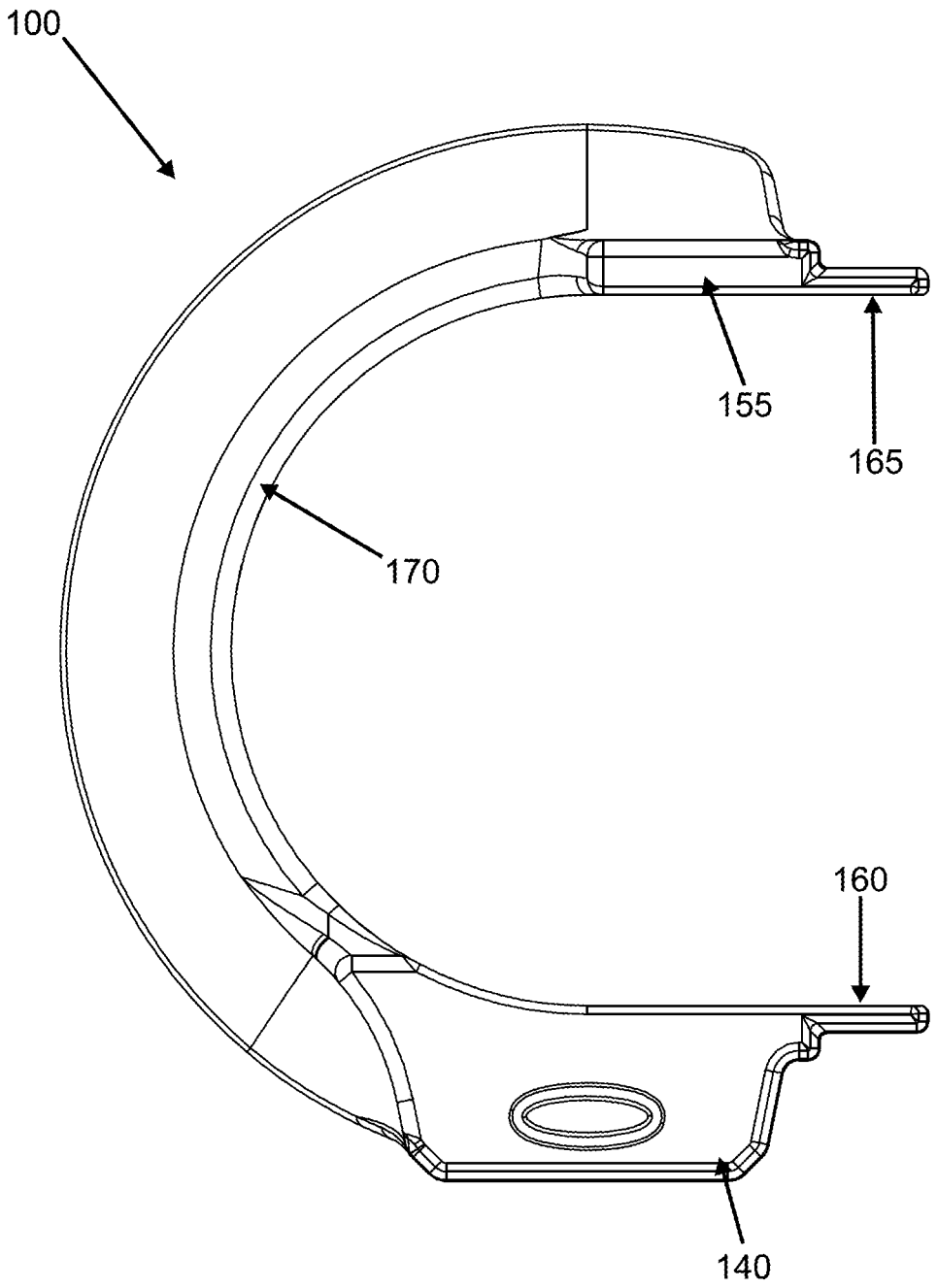

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

The disclosure provides a grenade pouch adapter. The grenade pouch adapter can be attached externally to a grenade pouch or a grenade holster. The grenade pouch adapter is configured to capture and position a spoon of a grenade so that the grenade is always positioned in an exact same way in the grenade pouch for consistency during employment. The grenade pouch adapter secures the spoon of the grenade and acts as a secondary safety device. In addition, the grenade pouch adapter uses the spoon to position the grenade in the grenade pouch regardless of a length of the grenade.

FIG. 1A, FIG. 1B, FIG. 1C, and FIG. 1D are diagrams of a grenade pouch adapter 100 in accordance with embodiments of the disclosure. As shown in FIGS. 1A-1D, grenade pouch adapter 100 includes a curved body 105. Curved body 105 includes a planar surface 110, an inner surface 115, and an outer surface 120. Outer surface 120 includes a first outer surface 125 and a second outer surface 130. Inner surface 115 extends perpendicularly from a first edge of planar surface 110 and defines an inner contour of curved body 105. First outer surface 125 extends perpendicularly from a second edge of planar surface 110. Second outer surface 130 extends from first outer surface 120 and curves towards inner surface 115.

Planar surface 110 includes a spoon aperture 135. Spoon aperture 135 is an opening of a spoon slot 140. Spoon slot 140 extends perpendicular to planar surface 110. Spoon slot 140 includes a cavity or an opening that extends from spoon aperture 135 and perpendicular to planar surface 110 into spoon slot 140. Spoon slot 140 may be formed or located at a first end 145 of curved body 105. A second end 150 of curved body 105 is located opposite of first end 145. A support structure 155 extends perpendicular to planar surface 110 at second end 150. In some examples, second end 150 of curved body 105 is located diametrically opposite of first end 145. In addition, support structure 155 is parallel to spoon slot 140.

Grenade pouch adapter 100 further includes a first lip 160 and a second lip 165. First lip 160 is located at first end 145 and may extend from spoon slot 140. Second lip 165 is located at second end 150 and may extend from support structure 155. First lip 160 and second lip 165 may be used to attach grenade pouch adapter 100 to a pouch. For example, first lip 160 and second lip 165 are configured to be sewable or weldable to a grenade pouch. An inner surface of each of first lip 160 and second lip 165 is flush with inner surface 115 of curved body 105. Inner surface 115 of curved body 105 extends up to or meets with a first edge of another planar surface 170 of curved body 105. Second outer surface 130 extends up to or meets with a second edge of another planar surface 170 of curved body 105. A thickness of another planar surface 170 is less than that of planar surface 110.

A length of spoon slot 140 may define an overall length of grenade pouch adapter 100. A length of inner surface 115 may define a length of curved body 105. A radius of curved body 105 is defined by inner surface 115 and is determined based on a diameter of a grenade to be positioned into grenade pouch adapter 100. A thickness of each of another planar surface 170 and planar surface 110 is determined based on a type of material used for forming grenade pouch adapter 100. Curved body 105 has an opening defined by inner surface 115 through which a grenade may be positioned in grenade pouch adapter 100.

Figure 2A:
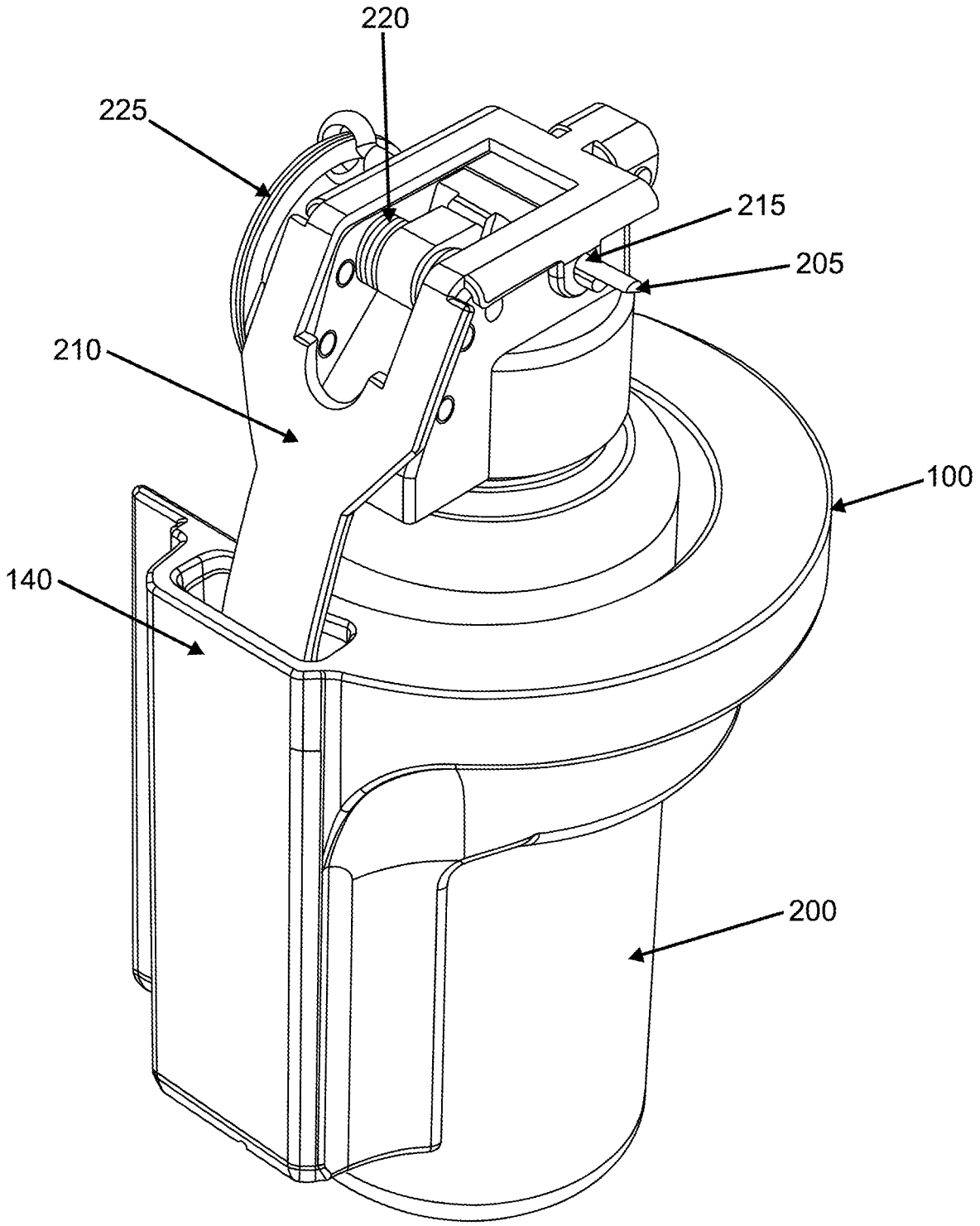
FIG. 2A, FIG. 2B, and FIG. 2C are diagrams showing a grenade positioned in the grenade pouch adapter of FIG. 1.
Figure 2B:
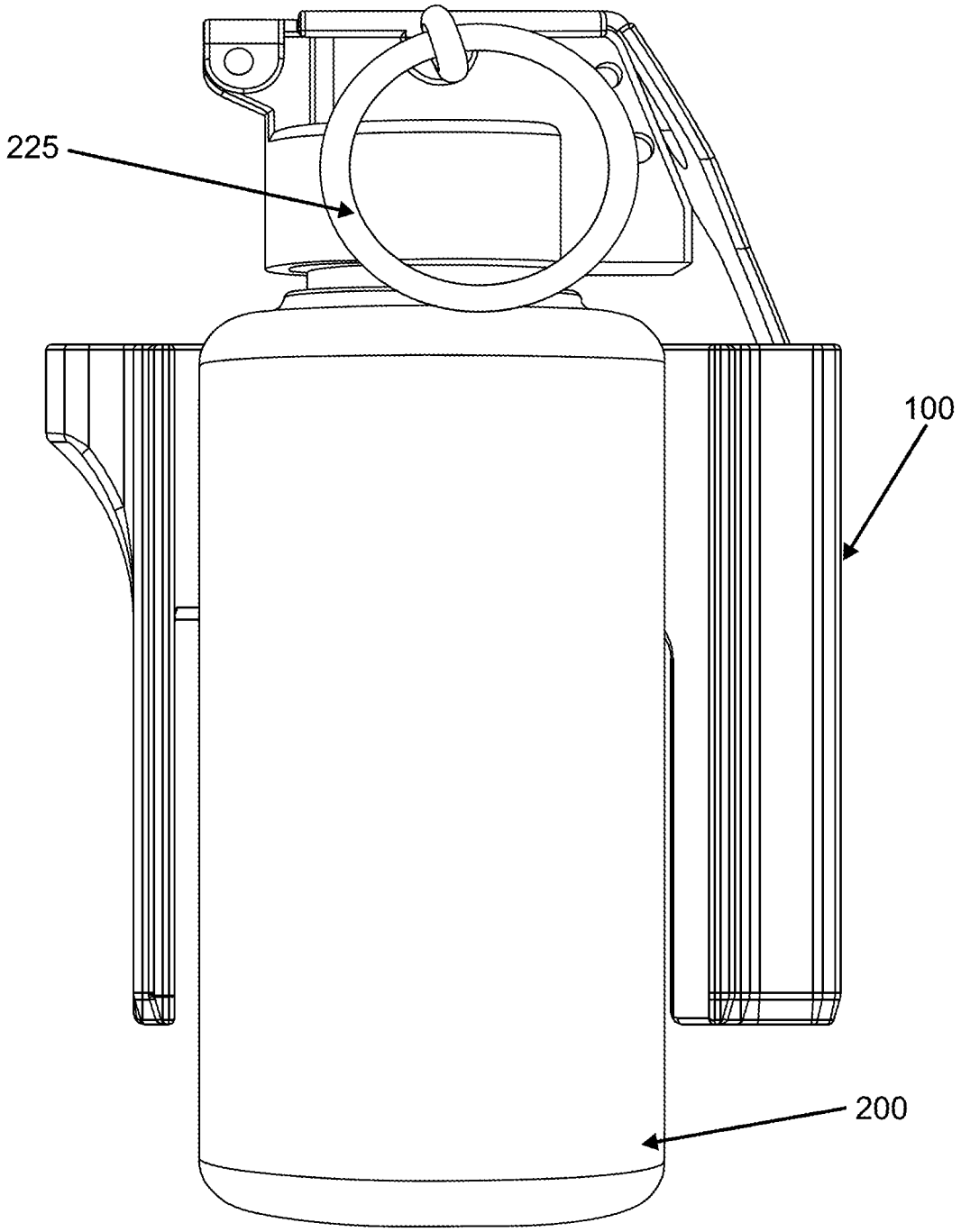
Figure 2C:
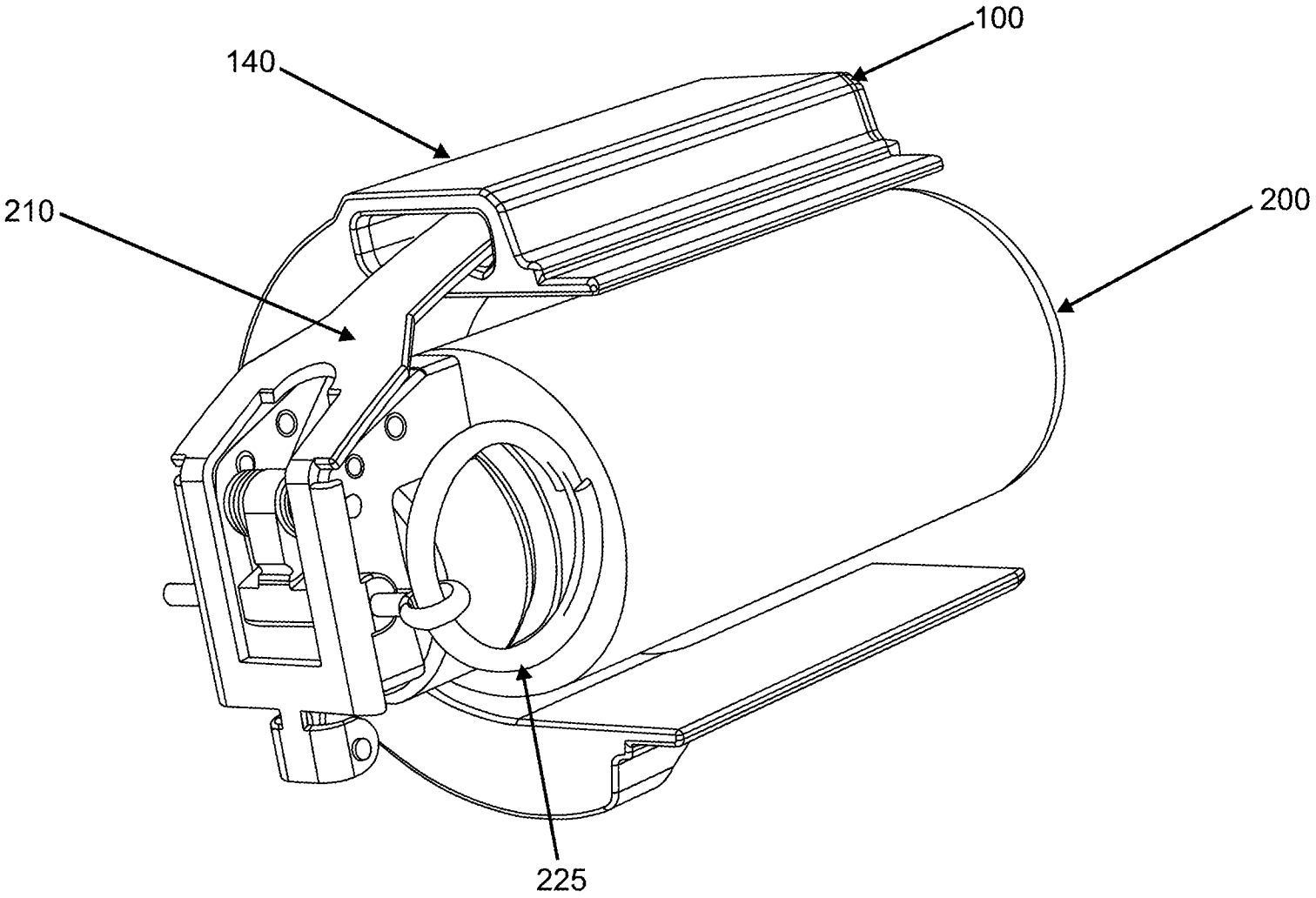

FIG. 2A, FIG. 2B, and FIG. 2C and diagrams illustrating a grenade 200 being positioned in grenade pouch adapter 100. As shown in FIGS. 2A-2C, grenade 200 includes a safety pin 205 and a spoon 210 (also referred to a grenade lever). Safety pin 205 is placed into a pin hole 215 that keeps spoon 210 in place, preventing a release spring 220 from releasing spoon 210 and detonating grenade 200. A safety pin ring 225 is provided at one end of safety pin 205. Grenade 200 is placed into grenade pouch adapter 100.

Grenade pouch adapter 100 captures and positions spoon 210 of grenade 200 into spoon slot 140 so that grenade 200 is always positioned in same way in a pouch for consistency during storage and removal. For example, and as shown in FIGS. 2A-2C, a portion of spoon 210 of grenade 200 is positioned inside spoon slot 140 of grenade pouch adapter 100. In addition, there is only orientation in which spoon 210 of grenade 200 can be positioned inside spoon slot 140 of grenade pouch adapter 100. In this orientation, safety pin ring 225 is positioned facing towards wearer's body. Grenade pouch adapter 100, therefore, secures spoon 210 and acts as a secondary safety device.

Moreover, grenade pouch adapter 100 uses spoon 210 to position grenade 200 in the pouch regardless of a length of grenade 200. The length of grenade 200 may vary depending on a number of charges grenade 200 produces. However, grenade pouch adapter 100 presents grenade 200 at the same height for an operator to retrieve. Spoon 210, for instance, generally has a set length/dimension, so no matter the length of grenade 200, grenade 200 is presented at the same height above the top opening of grenade pouch adapter 100 thereby enhancing repeatability/muscle memory during retrieval for the operator. Irrespective of length of grenade 200, spoon slot 140 stops grenade 200 and aligns it in the same place.

Grenade 200 is positioned in grenade pouch adapter 100 by orienting grenade 200 such that a second end of grenade 200 is aligned with the opening defined by inner surface 115 of curved body 105 and a second end of spoon 210 of grenade 200 is aligned with spoon aperture 135 on planar surface 110 of curved body 105. A first end of spoon 210 is attached to a first end of grenade 200. Once oriented, grenade 200 is lowered into grenade pouch adapter 100 until grenade 200 rests upon and is supported by grenade pouch adapter 100. Grenade 200 then is secured into grenade pouch adapter 100 through a grenade securing mechanism.

Figure 3:
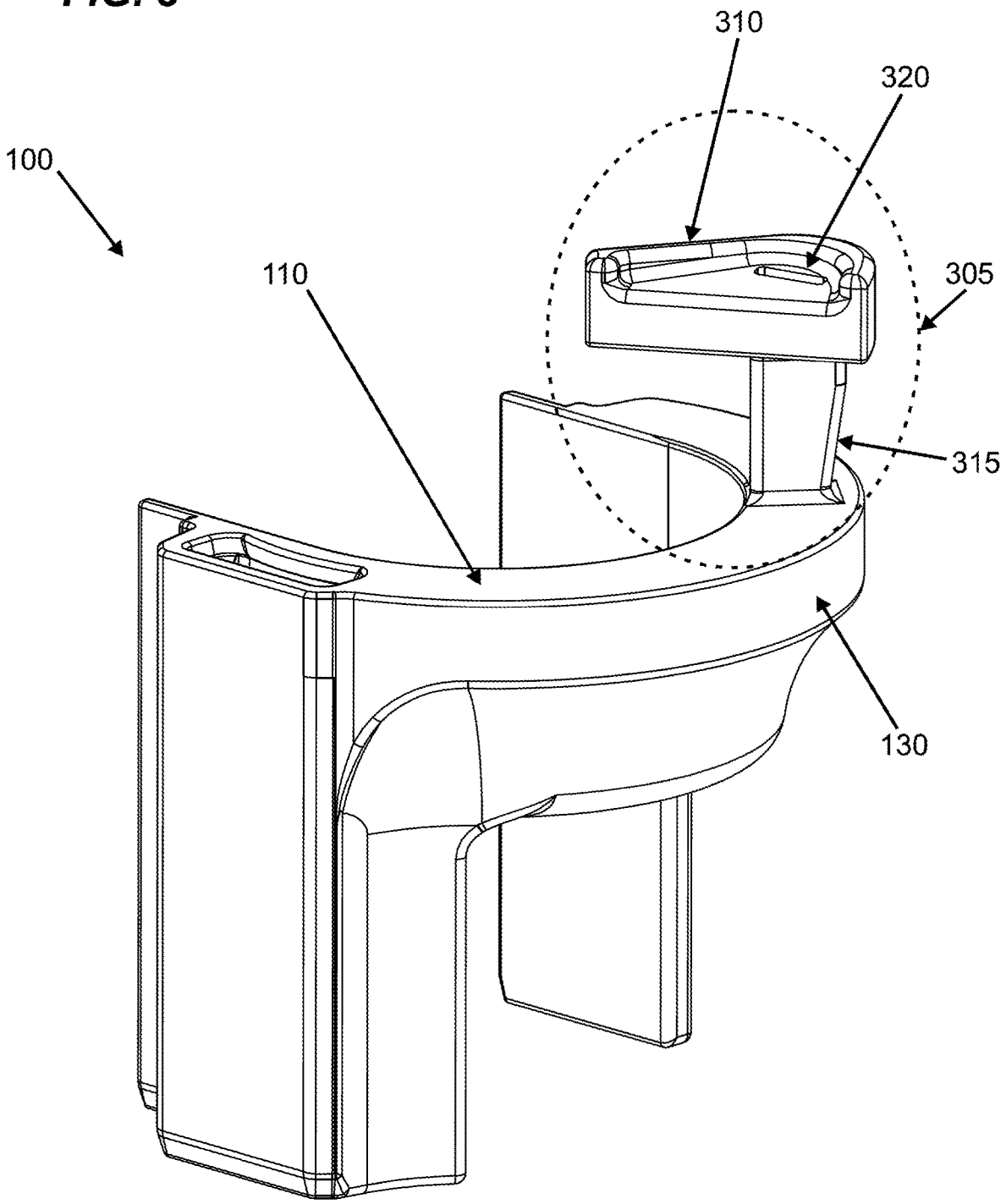
FIG. 3 is diagrams illustrating a grenade pouch adapter with a grenade securing mechanism.
Figure 4:
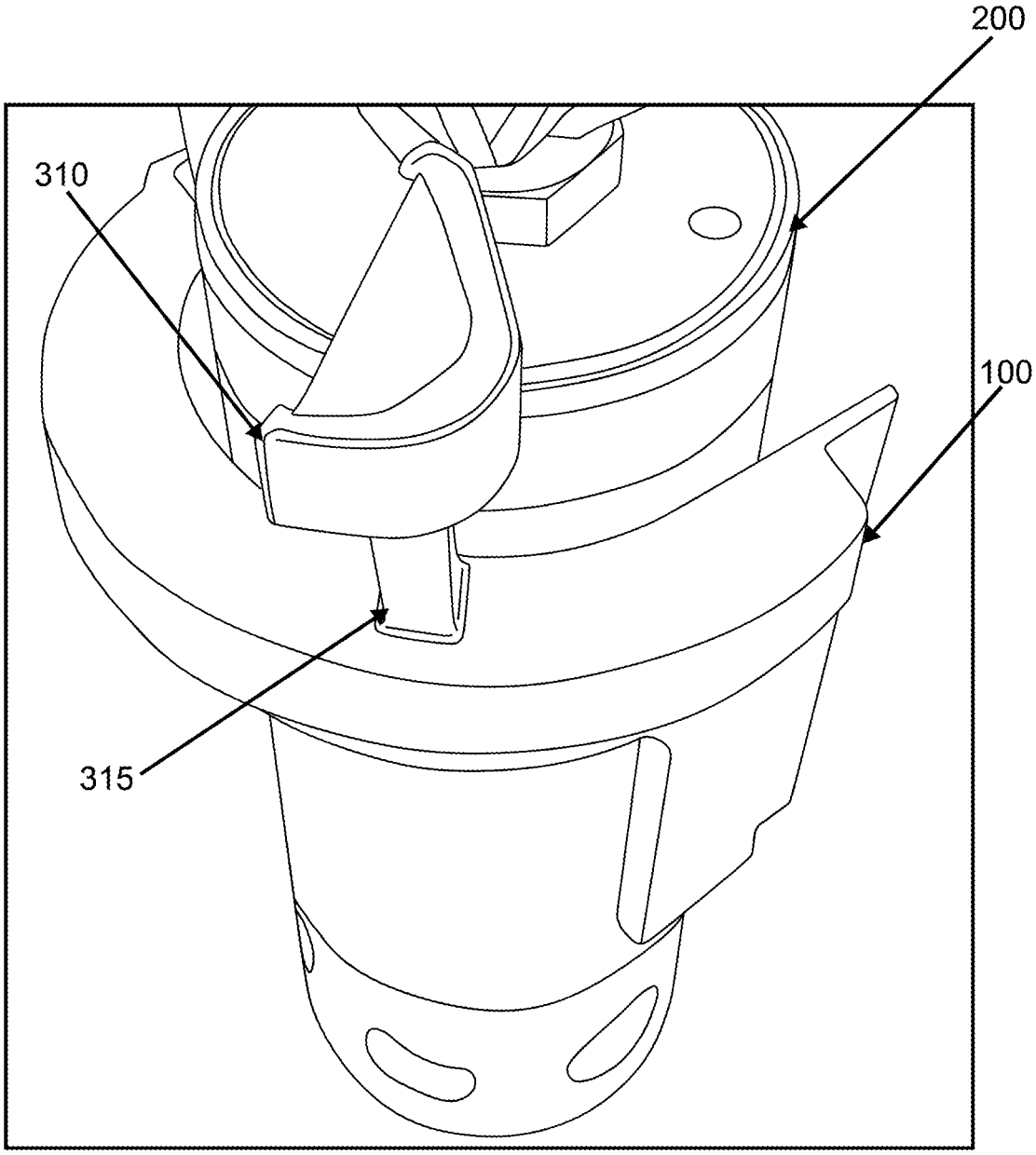
FIG. 4 is a diagram illustrating a grenade positioned and secured in a grenade pouch adapter.

FIG. 3 illustrates grenade pouch adapter 100 with a grenade securing mechanism, for example, a thumb latch lever 305. As shown in FIG. 3, thumb latch lever 305 includes a retention tab 310 and a retention lever 315. Retention lever 315 extends perpendicular to planar surface 110 of curved body 105. Retention tab 310 may extend parallel to planar surface 110 of curved body 105. A first end of retention lever 315 is connected to retention tab 310 and a second end of retention lever 315 is connected to planar surface 110 of curved body 105.

Retention tab 310 may sit on a top portion of a cylindrical body portion of grenade 200 thereby securing grenade 200 into grenade pouch adapter 100. Retention tab 310 is defeated by a downward swiping motion of a grenade grasping hand, thus clearing grenade 200 for extraction from the pouch and subsequent deployment. A top portion of retention tab 310 may include a grove to increase a friction between retention tab 310 and the grenade grasping hand.

A cavity 320 may run through retention tab 310 up to a portion of retention lever 315. A removal stiffener insert (not shown) fits into cavity 320. Stiffener insert aids in the rigidity of retention tab 310 thus aiding in the overall retention of grenade 200. Other types of securing mechanisms are contemplated and may be used to secure grenade 200 inside grenade pouch adapter 100. In some examples, grenade 200 is secured inside grenade pouch adapter 100 through a securing mechanism provided in a grenade pouch to which grenade pouch adapter 100 is attached to. For example, a grenade pouch can include a grenade securing mechanism having a pull tab mechanism. Other securing mechanisms include side release buckles, magnets, snaps/buttons, toggle/loop, and hook/loop (i.e., Velcro). The pull tab mechanism is quieter option compared to other securing mechanisms (i.e., Velcro and snap buttons).

Grenade pouch adapter 100 can be attached to a grenade pouch, for example, by sewing or welding. In some examples, only spoon slot 140 is attached or sewed to a grenade pouch. The spoon slot 140 is attached a grenade pouch such that to hold spoon 210 of grenade 200 in a single orientation such that safety pin ring 225 of grenade 200 is positioned facing towards wearer's body.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

The invention claimed is:

1. An apparatus comprising:

a grenade pouch adapter for receiving a grenade, the grenade comprising a spoon and a safety pin ring connected to a safety pin of the grenade, wherein the grenade pouch adapter comprises:

a curved body comprising a planar surface, an inner surface, and an outer surface, wherein the inner surface extends perpendicularly from a first edge of the planar surface and defines an inner contour of the curved body, and wherein the outer surface extends perpendicularly from a second edge of the planar surface; and a spoon slot located at a first end of the curved body, wherein the spoon of the grenade is received into the spoon slot through a spoon aperture formed on the planar surface of the curved body, and wherein the spoon slot is configured to hold the spoon of the grenade in a single orientation such that the safety pin ring of the grenade is positioned facing towards wearer's body.

2. The apparatus of claim 1, wherein the grenade pouch adapter further comprising a grenade securing mechanism.

3. The apparatus of claim 2, wherein the grenade securing mechanism comprises a retention tab and a retention lever, wherein a first end of the retention lever is connected to the retention tab and a second end of retention lever is connected to the planar surface of the curved body.

4. The apparatus of claim 3, wherein the retention tab sits on a top surface of a cylindrical body of the grenade.

5. The apparatus of claim 3, wherein the grenade securing mechanism comprises a cavity that runs through the retention tab up to a portion of the retention lever.

6. The apparatus of claim 5, wherein the cavity comprises a removable stiffener insert.

7. The apparatus of claim 1, wherein the grenade pouch adapter further comprises a support structure extending perpendicular to the planar surface at a second end of the curved body.

8. The apparatus of claim 1, wherein the grenade pouch adapter further comprises a first lip located at the first end and extending from the spoon slot.

9. The apparatus of claim 8, wherein the grenade pouch adapter further comprises a second lip located at a second end of the curved body and extending from a support structure.

10. The apparatus of claim 9, wherein the first lip and the second lip are used to attach the grenade pouch adapter to a pouch.

11. A grenade pouch adapter comprising:

a curved body for receiving a grenade, the grenade comprising a spoon and a safety pin ring connected to a safety pin of the grenade, wherein the curved body comprises a planar surface, an inner surface, and an outer surface, wherein the inner surface extends perpendicularly from a first edge of the planar surface and defines an inner contour of the curved body, and wherein the outer surface extends perpendicularly from a second edge of the planar surface; and a spoon slot located at a first end of the curved body, wherein the spoon of the grenade is received into the spoon slot through a spoon aperture formed on the planar surface of the curved body, and wherein the spoon slot is configured to hold the spoon of the grenade in a single orientation such that the safety pin ring of the grenade is positioned facing towards wearer's body.

12. The grenade pouch adapter of claim 11, further comprising a support structure extending perpendicular to the planar surface at a second end of the curved body.

13. The grenade pouch adapter of claim 12, further comprising:

a first lip located at the first end and extending from the spoon slot; and a second lip located at a second end of the curved body and extending from the support structure.

14. The grenade pouch adapter of claim 13, wherein the first lip and the second lip are attachable to a pouch.

15. The grenade pouch adapter of claim 11, further comprising a grenade securing mechanism.

16. The grenade pouch adapter of claim 15, wherein the grenade securing mechanism comprises a retention tab and a retention lever, wherein a first end of the retention lever is connected to the retention tab and a second end of retention lever is connected to the planar surface of the curved body.

17. The grenade pouch adapter of claim 16, wherein the grenade securing mechanism comprises a cavity that runs through the retention tab up to a portion of the retention lever, and wherein the cavity comprises a removable stiffener insert.

18. An apparatus comprising:

a grenade pouch for receiving a grenade, the grenade comprising a spoon and a safety pin ring connected to a safety pin of the grenade;

a curved body comprising a planar surface and an inner surface, wherein the inner surface extends perpendicularly from a first edge of the planar surface and defines an inner contour of the curved body;

a spoon slot attached to the grenade pouch, wherein the spoon of the grenade is received into a cavity of the spoon slot; and a grenade securing mechanism to prevent grenade from falling out of the grenade pouch, wherein the grenade securing mechanism comprises a pull tab mechanism.

* * * * *